US007562613B2

(12) United States Patent
Ahmad

(10) Patent No.: US 7,562,613 B2
(45) **Date of Patent: *Jul. 21, 2009**

(54) PROTECTIVE STRUCTURE AND PROTECTIVE SYSTEM

(75) Inventor: Jameel Ahmad, Forest Hills, NY (US)

(73) Assignee: The Cooper Union for the Advancement of Science and Art, New York, NY (US)

( * ) Notice: Subject to any disclaimer, the term of this patent is extended or adjusted under 35 U.S.C. 154(b) by 391 days.

This patent is subject to a terminal disclaimer.

(21) Appl. No.: 11/291,656

(22) Filed: Nov. 30, 2005

(65) Prior Publication Data

US 2008/0092471 A1 Apr. 24, 2008

Related U.S. Application Data

(63) Continuation-in-part of application No. 10/741,307, filed on Dec. 19, 2003, now Pat. No. 6,973,864.

(51) Int. Cl.
*F41H 5/04* (2006.01)
*F41H 5/24* (2006.01)

(52) U.S. Cl. ..... 89/36.02; 89/36.04; 428/911

(58) Field of Classification Search ..... 428/911; 89/36.04, 36.02

See application file for complete search history.

(56) References Cited

U.S. PATENT DOCUMENTS

| | | | |
|---|---|---|---|
| 1,335,780 | A | 4/1920 | Barton |
| 1,526,069 | A | 2/1925 | Irving |
| 1,554,767 | A | 9/1925 | Southern |
| 1,645,622 | A | 10/1927 | Prince |
| 2,181,466 | A | 11/1939 | Shackett |
| 2,669,114 | A | 2/1954 | Mills |

(Continued)

FOREIGN PATENT DOCUMENTS

| | | |
|---|---|---|
| JP | 10-140697 | 5/1998 |

OTHER PUBLICATIONS

Structural Design For Physical Security: State of the Practice, pp. 4-46 to 4-47 (American Society of Civil Engineers 1999) (ISBN 0-7844-0457-7).

(Continued)

*Primary Examiner*—Stephen M Johnson
(74) *Attorney, Agent, or Firm*—Goodwin Procter LLP

(57) ABSTRACT

A protective structure for protecting buildings, bridges, roads and other areas from explosive devices such as car bombs and the like comprises: (a) a mesh structure having an outer surface and an inner surface, wherein the inner surface defines an annular space; (b) a plurality of structural steel cables in contact with the mesh structure; (c) a composite fill material which resides within the annular space of the mesh structure and within the mesh structure; (d) at least one reinforcement member which resides within the composite fill material; and (e) a composite face material which resides upon the outer surface of the mesh structure. The mesh structure may be made up of, for example, steel wire. A protective system for protecting buildings, bridges, roads and other areas from explosive devices such as car bombs and the like comprises a plurality of the above described protective structures and a plurality of support members, wherein the support members provide interlocking engagement of the protective structures to the support members.

10 Claims, 8 Drawing Sheets

U.S. PATENT DOCUMENTS

| | | | | | |
|---|---|---|---|---|---|
| 3,874,134 | A | * | 4/1975 | Feldman et al. | 52/79.14 |
| 3,879,908 | A | | 4/1975 | Weismann | |
| 4,328,651 | A | | 5/1982 | Gutierrez | 52/293 |
| 4,454,702 | A | | 6/1984 | Bonilla-Lugo et al. | |
| 4,472,919 | A | | 9/1984 | Nourse | |
| 4,706,430 | A | | 11/1987 | Sugita et al. | |
| 4,999,965 | A | | 3/1991 | Schmidgall et al. | |
| 5,009,543 | A | | 4/1991 | Ahmad | |
| 5,163,263 | A | | 11/1992 | DeSchutter et al. | |
| 5,218,809 | A | | 6/1993 | Baumann | |
| 5,248,122 | A | | 9/1993 | Graham | |
| 5,291,715 | A | | 3/1994 | Basile | |
| 5,335,472 | A | | 8/1994 | Phillips | |
| 5,392,580 | A | | 2/1995 | Baumann | |
| 5,401,120 | A | | 3/1995 | Hussey et al. | |
| RE34,892 | E | | 4/1995 | Dunwoodie | 220/1.5 |
| 5,470,174 | A | | 11/1995 | Hu et al. | |
| 5,836,715 | A | | 11/1998 | Hendrix et al. | |
| 5,881,460 | A | * | 3/1999 | Nowell et al. | 29/897.34 |
| 5,997,792 | A | | 12/1999 | Gordon | |
| 6,041,562 | A | | 3/2000 | Martella et al. | |
| 6,263,629 | B1 | | 7/2001 | Brown, Jr. | |
| 6,305,432 | B1 | | 10/2001 | Sacks et al. | |
| 6,412,231 | B1 | | 7/2002 | Palatin | |
| 6,438,906 | B1 | | 8/2002 | Komarowski et al. | |
| 6,705,055 | B2 | | 3/2004 | Ritter et al. | |
| 6,973,864 | B1 | * | 12/2005 | Ahmad | 89/36.02 |
| 2001/0010140 | A1 | * | 8/2001 | Ritter et al. | 52/649.1 |

OTHER PUBLICATIONS

Various excerpts regarding "The Adler Blast Wall™" obtained from http://www.rsaprotectivatechnologies.com printed on Dec. 6, 2003.

Handout regarding "Adlar Blast Wall™ System" obtained by Dr. Jameel Ahmad in Oct. 2003.

International Search Report for PCT/US06/41353.

Written Opinion of the International Searching Authority for PCT/US06/41353.

* cited by examiner

PROTECTIVE STRUCTURE AND PROTECTIVE SYSTEM

CROSS-REFERENCE TO RELATED APPLICATIONS

This application is a continuation-in-part of U.S. patent application Ser. No. 10/241,307, filed on Dec. 19, 2003 now U.S. Pat. No. 6,973,864.

BACKGROUND OF THE INVENTION

1. Field of the Invention

This invention is directed to a protective structure and to a protective system for protecting buildings, streets, and other areas from explosions caused by an explosive device such as a bomb. More particularly, the protective structure and protective system employ a membrane-like mesh structure made up of, for example, steel wire. The mesh structure surrounds a composite fill material such as reinforced concrete. The protective structure deflects in response to and absorbs the energy associated with the blast load of an explosion, and the mesh structure prevents composite fragments from injuring people or property in the vicinity of the explosion. The protective structure may be sacrificial in nature, i.e., its sole purpose is to absorb the energy from the explosive shock wave and contain composite debris caused by the explosion, or the protective structure may be employed as a load-bearing structural component. Accordingly, this results in reduction in personal injury and property damage due to the explosion.

2. Background Information

Protection of people, buildings, bridges etc. from attacks by car or truck bombs, remote controlled explosives, etc. is of increasing importance and necessity. The explosive force or pressure wave generated by an explosive device such as a car bomb may be sufficient (depending on the size of the explosive device used) to disintegrate a composite wall, thereby causing shrapnel-like pieces of composite to be launched in all directions, and causing additional personal injury and property damage.

Conventional reinforced composite structures such as reinforced concrete walls are well known to those skilled in the art. Such conventional structures typically employ steel reinforcement bars embedded within the composite structure or wall. However, in the case of an explosion or blast load which may generate a pressure wave in excess of tens of thousands of psi, a conventional reinforced composite structure will be ineffective in providing sufficient protection, and the blast load will cause disintegration of the composite, thereby causing shrapnel-like pieces of composite to be launched in all directions, and causing additional personal injury and property damage.

One example of a proposed solution for this problem is the Adler Blast Wall™ which, is made up of front and back face plates which contain a reinforced concrete fill material. According to the developers of the Adler Blast Wall™, if an explosion occurs proximate to the front face plate, the back face plate will catch any concrete debris which results from the explosion. However, if the back face plate of the Adler Blast Wall™ is sufficiently displaced in the horizontal or vertical direction due to the explosion, small pieces of concrete debris traveling at high velocities may escape, thereby causing personal injury or property damage. Accordingly, there is a need for a protective structure which further minimizes the possibility that such small pieces of concrete debris traveling at high velocities will escape the protective structure employed.

It is a first object of this invention to provide a blast resistant protective structure which minimizes the possibility that small pieces of concrete debris traveling at high velocities will escape the protective structure in the event of an explosion or blast load proximate to the structure.

It is one feature of the protective structure of this invention that it employs a membrane- like mesh structure made up of, for example, steel wire, and structural steel cables in contact with the mesh structure, for example welded to the mesh structure forming a cage around it, or interwoven into the mesh structure. The mesh structure is compressible in all three dimensions, and surrounds a composite fill material such as reinforced concrete, fiber reinforced plastics, molded plastics, or other composite plastics. In the event of an explosion proximate to the protective structure of this invention, the mesh structure advantageously prevents composite fragments produced due to disintegration of the composite fill material of the protective structure from injuring people or property in the vicinity of the explosion.

It is another feature of the protective structure of this invention that, in the event of an explosion proximate to the protective structure of this invention, the protective structure deflects in response to and absorbs the energy associated with the blast load of the explosion.

It is a second object of this invention to provide a protective system which employs a number of the above described protective structures which are joined together via a number of support members, thereby providing a protective wall of sufficient length to provide more complete protection of a given area as well as additional ease of construction and use. The protective system may be used, but is not limited to use in constructing buildings, tunnels, portals etc.

It is a feature of the protective system of the invention that the support members be capable of receiving the respective ends of the protective structures to provide an integrated wall structure.

It is another feature of the protective system of the invention that the support members may also employ a mesh structure made up of, for example, steel wire. The mesh structure may surround a composite fill material such as reinforced concrete, fiber reinforced plastics, molded plastics, or other composite plastics. Thus, in the event of an explosion proximate to the protective system of this invention, the mesh structure prevents concrete fragments produced due to disintegration of the concrete fill material of the support members from injuring people or property in the vicinity of the explosion.

Other objects, features and advantages of the protective structure and protective system of this invention will be apparent to those skilled in the art in view of the detailed description of the invention set forth herein.

SUMMARY OF THE INVENTION

A protective structure such as a protective wall for protecting buildings, bridges, roads and other areas from explosive devices such as car bombs and the like comprises:

(a) a mesh structure having an outer surface and an inner surface, wherein the inner surface defines an annular space;

(b) a plurality of structural steel cables in contact with the mesh structure;

(c) a composite fill material which resides within the annular space of the mesh structure and within the mesh structure;

(d) at least one reinforcement member which resides within the composite fill material; and (e) a composite face material which resides upon the outer surface of the mesh structure.

A protective system such as a protective wall for protecting buildings, bridges, roads and other areas from explosive devices such as car bombs and the like comprises:

(I) a plurality of adjacent protective structures, wherein each protective structure has a first end and a second end, and each protective structure comprises:

(a) a mesh structure having an outer surface and an inner surface, wherein the inner surface defines an annular space, (b) a plurality of structural steel cables in contact with the mesh structure;

(c) a composite fill material which resides within the annular space of the mesh structure and within the mesh structure, (d) at least one reinforcement member which resides within the composite fill material, and (e) a composite face material which resides upon the outer surface of the mesh structure; and (II) a plurality of support members, wherein the support members receive the first or second ends of the protective structures to provide interlocking engagement of the protective structures to the support members.

DETAILED DESCRIPTION OF THE INVENTION

Figure 1:
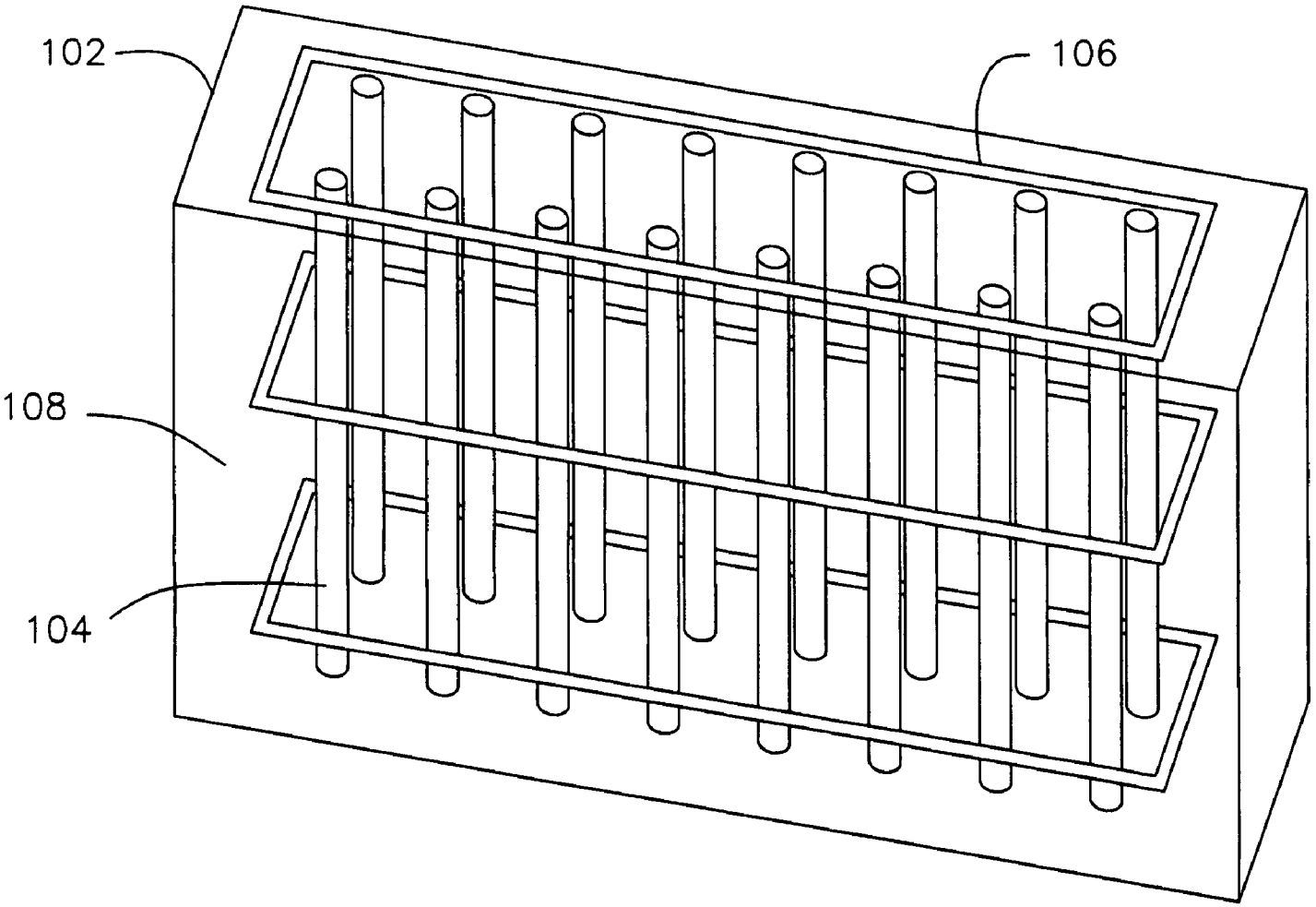
FIG. 1 PRIOR ART
FIG. 1 depicts a cross-sectional view of a prior art reinforced composite wall protective structure.

This invention will be further understood in view of the following detailed description. Referring now to FIG. 1, there is depicted a cross-sectional view of a prior art reinforced composite wall protective structure. As shown in FIG. 1, composite wall 102 contains both vertically placed steel reinforcement bars 104 and horizontally placed steel reinforcement bars 106. If an explosion occurred in the vicinity of the front face 108 of composite wall 102, the composite material would disintegrate, and small pieces of composite debris traveling at high velocities would be produced, thus increasing the possibilities of personal injury and property damage due to such composite debris.

Figure 2:
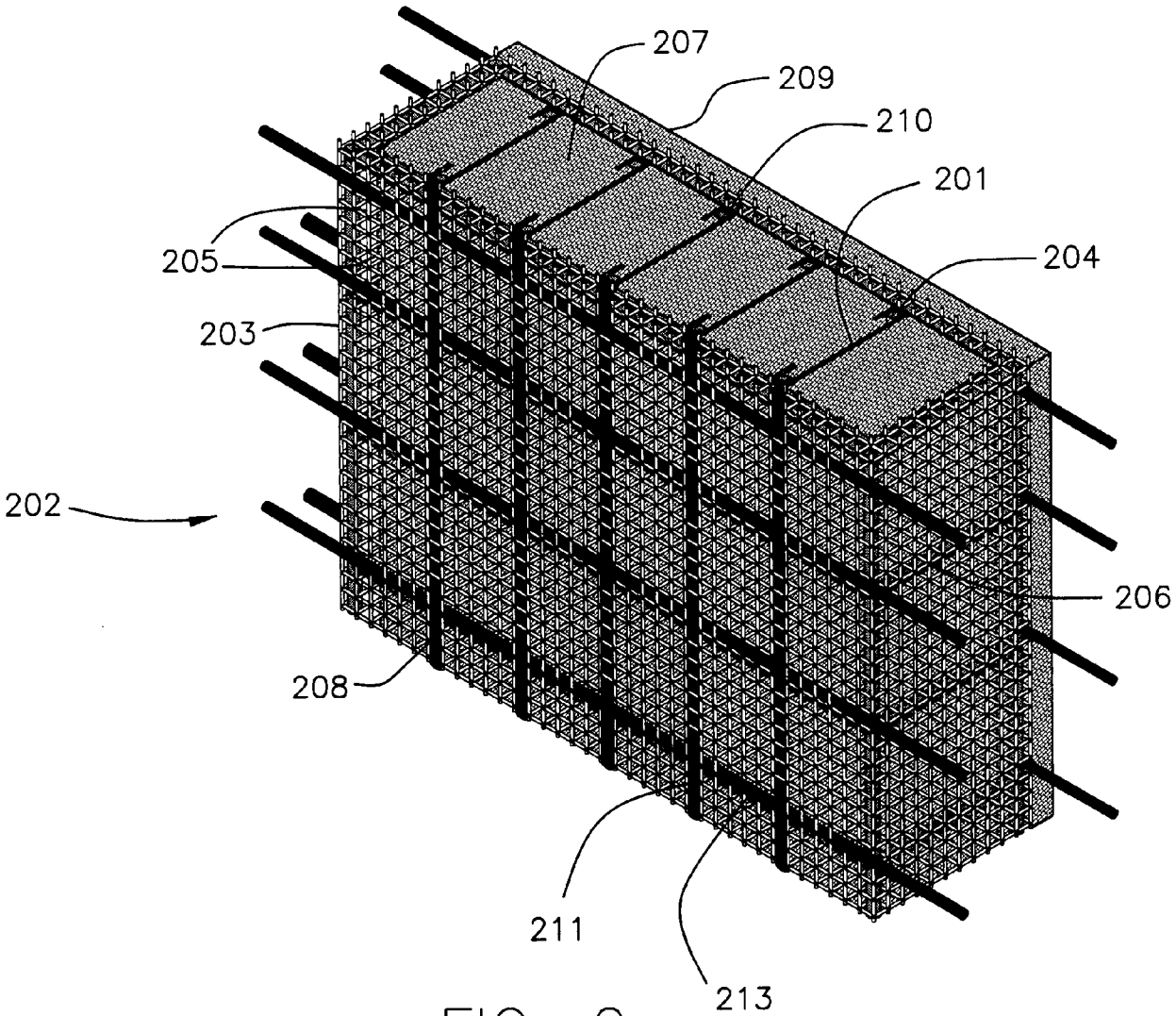
FIG. 2 depicts a cross-sectional view of one embodiment of the protective structure of this invention.

FIG. 2 depicts a cross-sectional view of one embodiment of the protective structure of this invention. As shown in FIG. 2, composite wall 202 contains membrane-like mesh structure 203 made up of steel wires 205, as well as vertically placed steel reinforcement bars 204 (connected by steel tie members 201) and horizontally placed steel reinforcement bars 206. Mesh structure 203 defines an annular region which contains composite fill material 207. Structural steel cables 213 are woven horizontally into mesh structure 203. Structural steel cables 211 are woven vertically into mesh structure 203. Although shown only with respect to the rear face 209 of composite wall 202, composite fill material 207 may and preferably does protrude through mesh structure 203 on all sides to provide composite face material 210. If an explosion occurred in the vicinity of the front face 208 of composite wall 202, the composite material would disintegrate, but small pieces of composite debris traveling at high velocities would be "caught" and contained within the mesh structure 203, thus decreasing the possibilities of personal injury and property damage due to such composite debris. If desired, one or more additional mesh structures (not shown) may be attached or superimposed upon mesh structure 203, thereby adding additional unit cell thickness and providing additional containment for small pieces of composite debris generated by disintegration of composite wall 202 after an explosion.

Figure 2A:
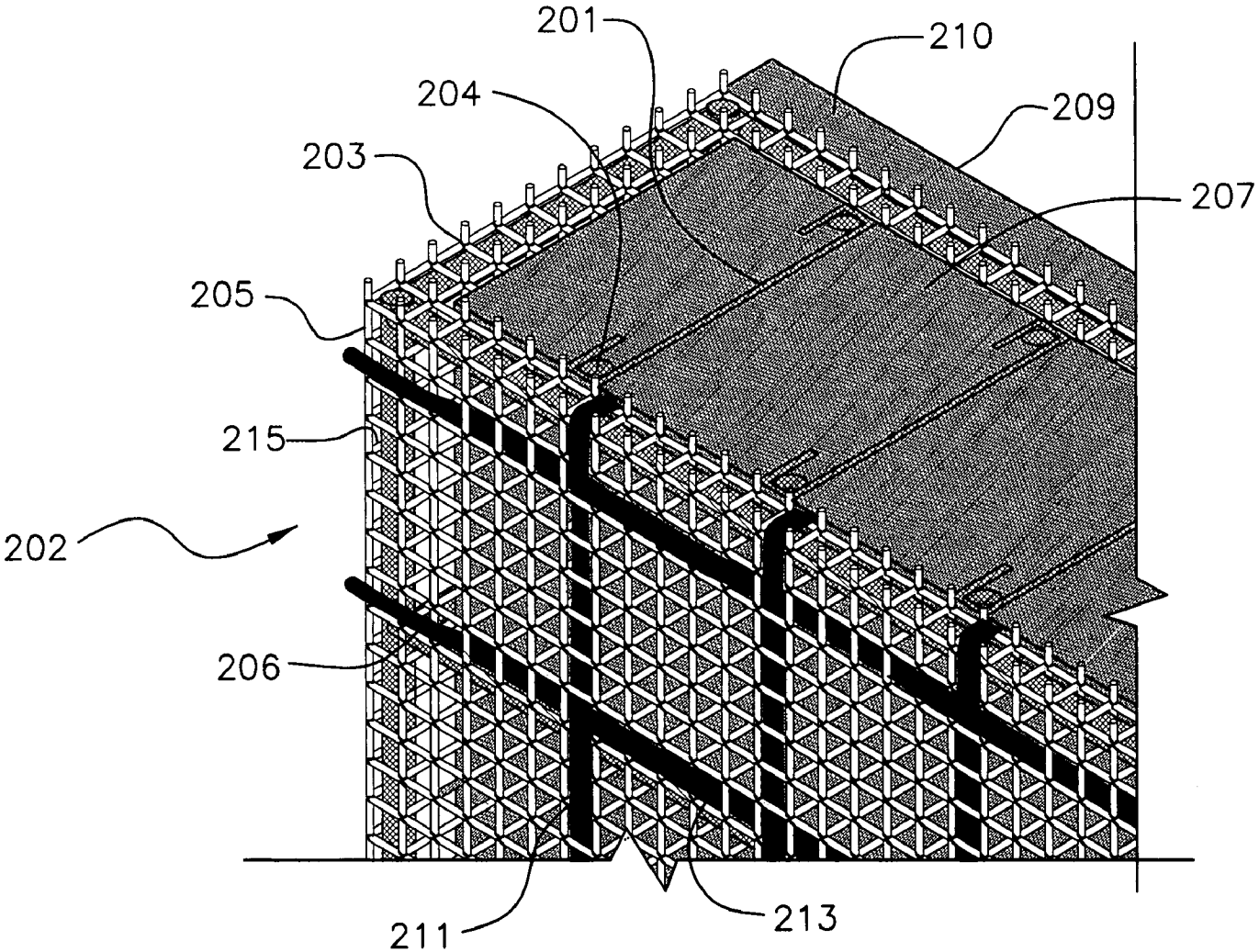
FIG. 2A depicts a cross-sectional expanded view of a portion of the protective structure of this invention depicted in FIG. 2.

FIG. 2A depicts a cross-sectional expanded view of a portion of the protective structure of this invention depicted in FIG. 2. As shown in FIG. 2A, composite wall 202 contains mesh structure 203 made up of steel wires 205 which define mesh structure unit cells 215, as well as vertically placed steel reinforcement bars 204 (connected by steel tie members 201) and horizontally placed steel reinforcement bars 206. Mesh structure 203 defines an annular region which contains composite fill material 207. The wire mesh which may be employed in the mesh structure is preferably made up of interconnected steel wires. Such steel wires will be selected based upon the assumed maximum blast load, the length of the protective structure, the grade strength of the steel employed in the mesh, and other factors. For example, steel wires having a thickness of 8 gage, 10 gage, 12 gage, or 16 gage may be employed. The mesh structure preferably comprises a plurality of mesh unit cells having a width in the range of about 0.75 to 1.75 inches and a length in the range of about 0.75 to 1.75 inches, although the opening size of the mesh structure may be optimally designed depending upon the properties of the composite fill material. Structural steel cables 213 are woven horizontally into mesh structure 203. Structural steel cables 211 are woven vertically into mesh structure 203. The steel cables may be spaced horizontally at a fraction of the height of the wall, for example the cables may be spaced apart at a distance of ¼ of the height of the wall. The steel cables may be spaced vertically at a fraction of the length of the wall, for example the cables may be spaced apart at a distance of ⅙ of the length of the wall. Steel cables having a thickness of from 16 gage to having a diameter of several inches may be employed. The steel cables may be single strand cables or composite cables made up of high strength steel wires.

It has previously been suggested, for example, in Conrath et al., Structural Design for Physical Security, pp.4-46 (American Society of Civil Engineers-Structural Engineering Institute 1999) (ISBN 0-7844-0457-7), that wire mesh may be employed on or just beneath the front and rear surfaces of structural elements to mitigate "scabbing" (i.e., cratering of the front face due to the blast load) and "spalling" (i.e., separation of particles of structural element from the rear face at appropriate particle velocities) for light to moderate blast loads. However, in the protective structure of the present invention, the wire mesh structure employed does not merely mitigate scabbing and spalling for light to moderate blast loads. Instead, the wire mesh structure both prevents spalling at all blast loads (including high blast loads which generate a pressure wave in excess of tens of thousands of psi), and also enables the protective structure to deflect both elastically and inelastically in response to the blast load, as further discussed herein with respect to FIG. 4, such that the energy of the blast load is fully absorbed by the protective structure via large deflections of the protective structure. Due to such large deflections, the wire mesh structure is deformed permanently without any "rebound" back towards its initial position prior to the explosion.

Figure 3:
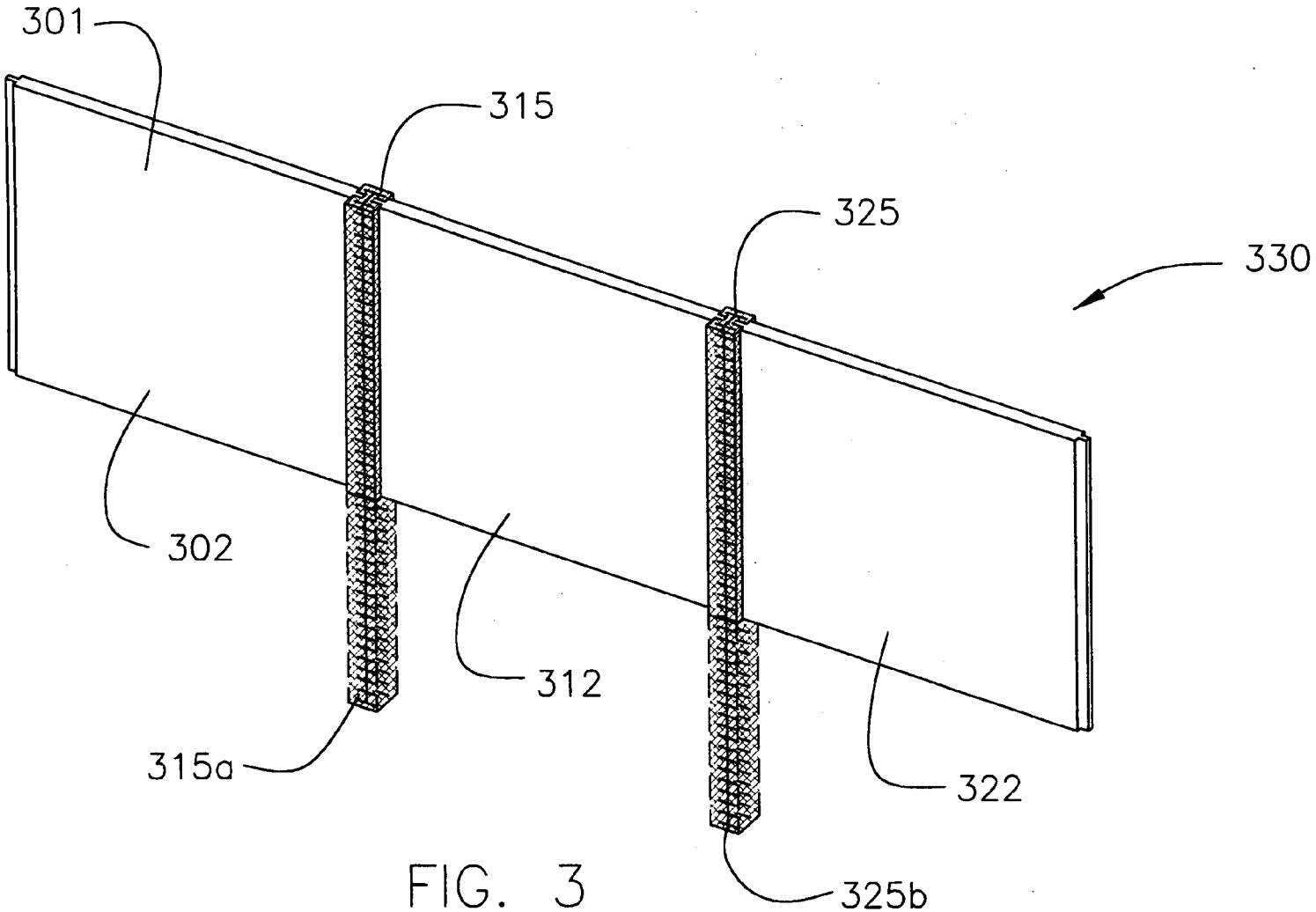
FIG. 3 depicts a front view of one embodiment of the protective system of this invention.

FIG. 3 depicts a front view of one embodiment of the protective system of this invention. As shown in FIG. 3, the protective system 301 includes several protective structures of this invention 302, 312, and 322 (each of which has the structure depicted in FIG. 2) which are interconnected via the use of support members 315 and 325. The support members 315 and 325 typically will have a length sufficient to enable the support members to be embedded in the ground for a significant portion of their total length, as shown for example, by support member portions 315*a* and 325*a* which are embedded in the ground 330 in FIG. 3.

The embedded depth for the support member portions 315*a* and 325*a* in the ground will be determined according to the subsurface soil conditions, as will be recognized by those skilled in the art. For example, in one preferred embodiment, the embedded length of the support member portions in the soil will be a minimum of about one-third of the total length of each support member.

In another preferred embodiment, the support members comprise a mesh structure. The mesh structure of the support members may preferably comprise a plurality of interconnected steel wires. Such steel wires will be selected based upon the assumed maximum blast load, the length of the protective structure, the grade strength of the steel employed in the mesh, and other factors. For example, steel wires having a thickness of 8 gage, 10 gage, 12 gage, or 16 gage may be employed. The mesh structure, if employed, preferably comprises a plurality of mesh unit cells having a width in the range of about 0.75 to 1.75 inches, and a length in the range of about 0.75 to 1.75 inches, although the opening size of the mesh structure may be optimally designed depending upon the properties of the composite fill material. The mesh structure, if employed, preferably surrounds a composite fill material such as reinforced concrete. The composite fill material preferably protrudes through the mesh structure on all sides to provide a composite face material for the support member. Vertically and horizontally placed steel cables may be in contact with the mesh structure.

Figure 4:
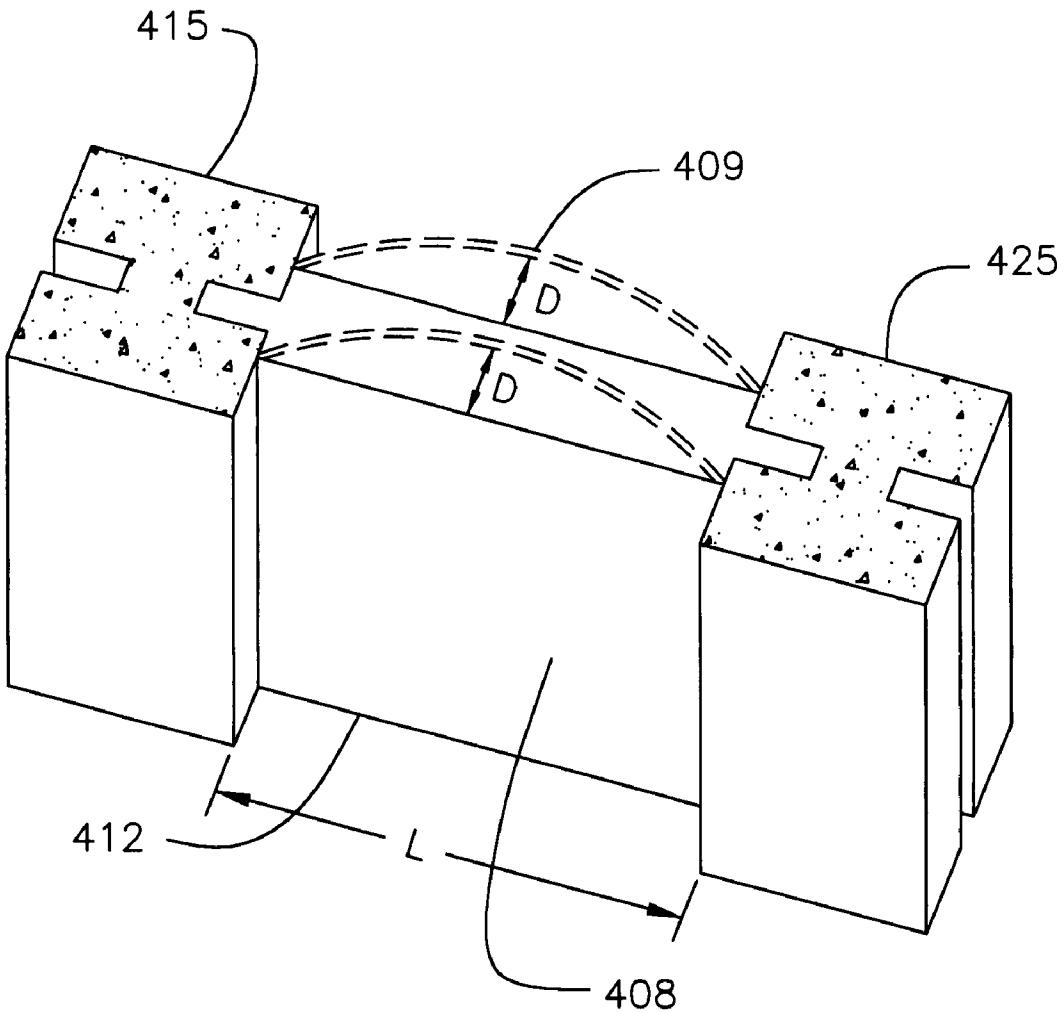
FIG. 4 depicts a cross-sectional view of the deflection of one embodiment of the protective structure of this invention in response to a blast load.

FIG. 4 depicts a cross-sectional view of the deflection of one embodiment of the protective structure of this invention in response to a blast load. As shown in FIG. 4, a protective structure of this invention 412 is interconnected to support members 415 and 425. Protective structure 412 has a length L as shown. Upon explosion of an explosive device proximate to the front face 408 of protective structure 412, the wire mesh (not shown in FIG. 4) will deflect in response to the blast load, thereby causing both front face 408 and rear face 409 of protective structure 412 to deflect a distance D (shown in dashed lines). For the protective structure of this invention, which is designed to undergo large deflections to absorb the energy from the explosion, deflection of the protective structure (i.e. the D/L ratio) may be as large as about 25%, say 10-25%.

Figure 5:
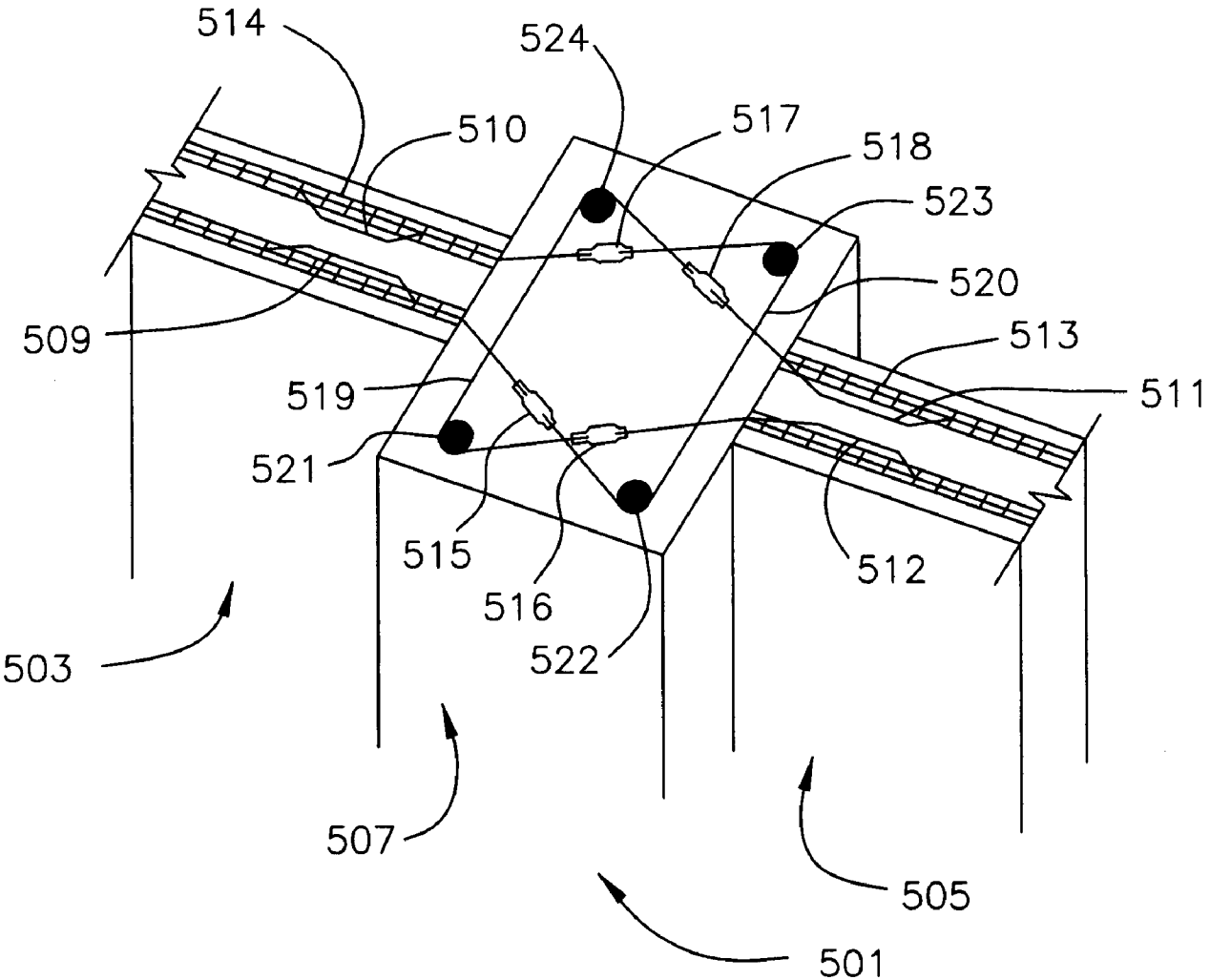
FIG. 5 depicts a cross-sectional view of one embodiment of the protective system of this invention.

FIG. 5 depicts a cross-sectional view of one embodiment of the protective system of this invention. As shown in FIG. 5, the protective system 501 includes several protective structures 503 and 505 which are interconnected via the use of support member 507. Steel cables 509, 510, 511, and 512 are woven horizontally into wire mesh structures 513 and 514 and are interconnected within support member 507. Steel cable 509 is connected to turnbuckle 515 within support member 507. Steel cable 510 is connected to turnbuckle 517 within support member 507. Steel cable 511 is connected to turnbuckle 518 within support member 507. Steel cable 512 is connected to turnbuckle 516 within support member 507. Turnbuckles 515 and 517, are connected to steel cable 520 which loops around steel reinforcement members 522 and 523. Turnbuckles 516 and 518 are connected to steel cable 519 which loops around steel reinforcement members 521 and 524.

Turnbuckles are well known to those of ordinary skill in the art as described for example in *Manual of Steel Construction,* American Institute of Steel Construction, p. 4-149 ($9_{th}$ Ed. Oct. 1994).

Figure 6:
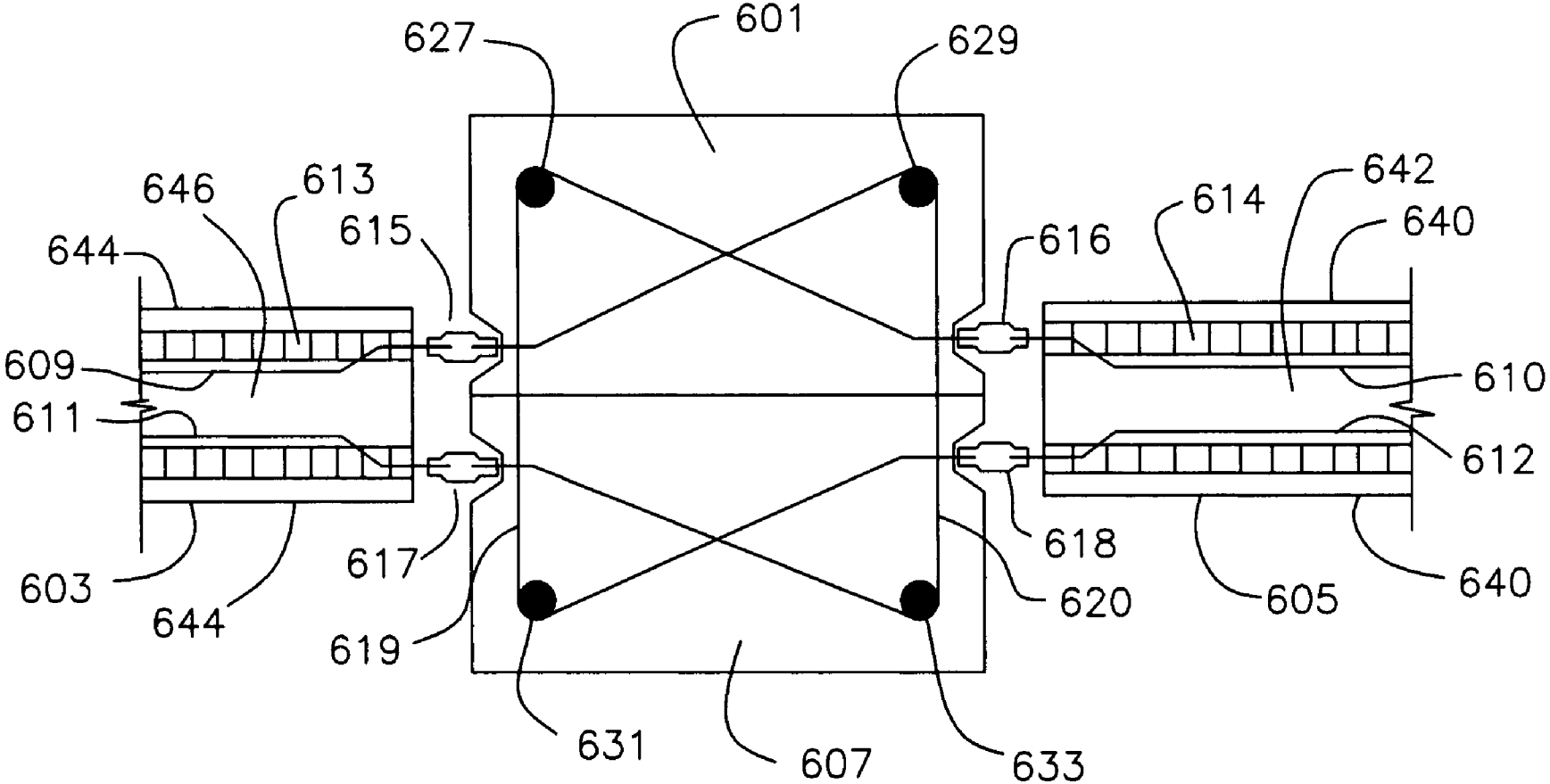
FIG. 6 depicts a cross-sectional view of a second embodiment of the protective system of this invention.

FIG. 6 depicts a cross-sectional view of another embodiment of the protective system of this invention. As shown in FIG. 6, the protective structure 601 includes several protective structures 603 and 605 which are interconnected via the use of support member 607. Concrete fill 646 protrudes through mesh structure 613 to form front and back faces 644 of protective structure 603. Concrete fill 642 protrudes through mesh structure 614 to form front and back faces 640 of protective structure 605. Steel cable 609 is woven horizontally into wire mesh structure 613 and is connected to turnbuckle 615. Steel cable 610 is woven horizontally into wire mesh structure 614 and is connected to turnbuckle 616. Steel cable 611 is woven horizontally into wire mesh structure 613 and is connected to turnbuckle 617. Steel cable 612 is woven horizontally into wire mesh structure 614 and is connected to turnbuckle 618. Steel cable 619 is connected to turnbuckles 616 and 618 and loops around steel reinforcement members 627 and 631. Steel cable 620 is connected to turnbuckles 615 and 617 and loops around steel reinforcement members 629 and 633.

Figure 7:
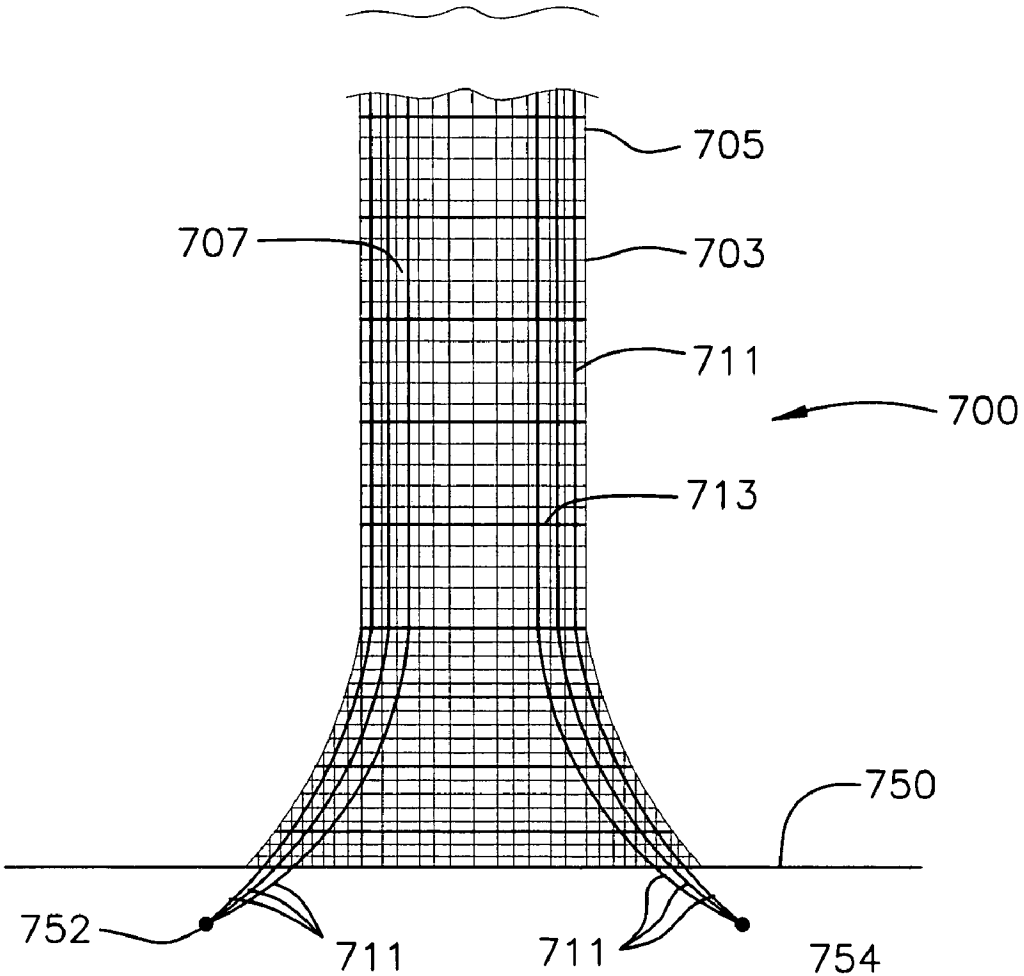
FIG. 7 depicts a third embodiment of the protective system of this invention.

FIG. 7 depicts another embodiment of this invention. In FIG. 7, a portion of a building structure (in this case a tower 700) is shown. Tower 700 has as its exterior facade mesh structure 703 made up of steel wires 705 as well as structural steel cables 713 woven horizontally into mesh structure 703 and structural steel cables 711 woven vertically into mesh structure 703 (not all of the structural steel cables 711 are shown). The mesh structure defines an annular region which contains composite fill material 707 (which in this case is concrete). The concrete fill material may and preferably does protrude through mesh structure 703 to provide a concrete face material (not shown) which may form the exterior surfaces of tower 700. Alternatively, the concrete fill material may not protrude through mesh structure 703, in which case a separate face material (not shown) may be affixed to the concrete fill material or otherwise form the visible exterior surface of tower 700. As shown in FIG. 7, steel cables 711 extend below the ground surface 750 and are joined or anchored at points 752 and 754.

In another embodiment, the protective system may contain apertures formed by a plurality of mesh structures. For example, apertures for architectural features such as windows and doors may be provided between the mesh structures.

While not wishing to be limited to any one theory, it is theorized that the deflection of the protective structure of this invention in response to a blast load may be analogized or modeled as wires in tension. Upon explosion of the explosive device and delivery of the blast load to the protective structure, the steel wires of the mesh structure absorb the energy of the blast load. Employing this model, the membrane stiffness of the mesh wire (K) is defined as:

$$K=P_e/D_e$$

where $P_e$ is the load corresponding to the elastic limit of the wire mesh structure and $D_e$ is the deflection corresponding to $P_e$, and the time period of oscillation of the wire mesh structure (T) (in milliseconds) is defined as:

$$T=1000/\omega$$

where ω is the frequency of oscillation in cycles per second (cps), which is defined as $$\omega=(1/2\pi)(K/m)^{1/2}$$

where m is the mass per foot-width of the mesh structure.

Using the above equations, various design parameters such as the wire gage, size of the mesh unit cell opening, steel grade, etc. may be selected for various blast loads, as set forth in Table 1 below. These design parameters pertain to the mesh structure itself, not including the steel cables.

TABLE 1

| | Wire Gage # | Wire Diameter (in.) | Wire Area(A) ($in^2$) | ΣA ($in^2$) | $R_u$ (k) | $P_e$ (k) | $D_e$ (in.) | K (#/in) | m (lb-$s^2$/in.) | ω (cps) | T (milli-seconds) |
|---|---|---|---|---|---|---|---|---|---|---|---|
| $F_y$ = 36 ksi | 16 | 0.062 | 0.003 | 0.290 | 10.44 | 1.09 | 3.77 | 289 | 0.0308 | 15 | 66 |
| $L_m$ = 72 in. | 12 | 0.106 | 0.0088 | 0.847 | 30.48 | 3.18 | 3.77 | 893 | 0.0899 | 15 | 66 |
| | 10 | 0.135 | 0.014 | 1.373 | 49.44 | 5.16 | 3.77 | 1,368 | 0.1458 | 15 | 66 |
| $F_y$ = 50 ksi | 16 | 0.062 | 0.003 | 0.290 | 14.50 | 1.707 | 4.15 | 411 | 0.0308 | 18.4 | 54 |
| $L_m$ = 72 in. | 12 | 0.106 | 0.0088 | 0.847 | 42.35 | 4.985 | 4.15 | 1201 | 0.0899 | 18.4 | 54 |
| | 10 | 0.135 | 0.014 | 1.373 | 68.65 | 8.082 | 4.15 | 1947 | 0.1458 | 18.4 | 54 |

where:

ΣA is the sum of the area of the wires per 1 foot-width of mesh structure $R_u$ is the ultimate load capacity of the wire mesh per foot $F_y$ is the yield stress of the wire $L_m$ is the span of the wire mesh structure As set forth in Table 1, the time period T is a critical design parameter which may be designed for in the protective structure of this invention. For a given explosion or blast load, it is expected that the time duration of the blast load ($t_d$) will be in the order of a few milliseconds, say 5-10 milliseconds. The mesh structure employed in the protective structure of this invention will be designed such that it will have a time period T much greater than $t_d$; typically T is of the order of 5-20 times greater in duration than $t_d$.

It should be understood that various changes and modifications to the preferred embodiments herein will be apparent to those skilled in the art. Such changes and modifications can be made without departing from the spirit and scope of this invention and without diminishing its attendant advantages. It is therefore intended that such changes and modifications be covered by the appended claims.

The invention claimed is:

1. A protective structure for protection from a blast load comprising:

(a) a mesh structure having an outer surface and an inner surface, wherein the inner surface defines an annular space;

(b) a plurality of structural steel cables in contact with the mesh structure;

(c) a composite fill material which resides within the annular space of the mesh structure and within the mesh structure;

(d) at least one reinforcement member which resides within the composite fill material; and (e) a composite face material which resides upon the outer surface of the mesh structure, wherein the blast load has a time duration of $t_d$, the mesh structure has a time period of oscillation T in response to the blast load, and T is 5-20 times greater than $t_d$.

2. The protective structure of claim 1, in which the mesh structure comprises a plurality of interconnected steel wires.

3. The protective structure of claim 2, in which the steel wires are selected from the group consisting of 8 gage, 10 gage, 12 gage, or 16 gage steel wires.

4. The protective structure of claim 2, in which the mesh structure comprises a plurality of mesh unit cells having a width in the range of about 0.75 to 1.75 inches and a length in the range of about 0.75 to 1.75 inches.

5. The protective structure of claim 1, in which the composite fill material permeates through the mesh structure to form the composite face material.

6. The protective structure of claim 1, in which the reinforcement member is a steel reinforcement bar.

7. The protective structure of claim 1, in which the structure contains a plurality of reinforcement members located within the composite fill material.

8. The protective structure of claim 1, in which the structure deflects in response to the blast load.

9. The protective structure of claim 8, in which the deflection in response to the blast load is 25% or less of the length of the protective structure.

10. The protective structure of claim 1, in which the structure is a wall.

* * * * *